United States Patent [19]

Lowe et al.

[11] 4,133,308

[45] Jan. 9, 1979

[54] PROTECTIVE DEVICES

[75] Inventors: Brian A. Lowe, Cheshunt; Raymond Odell, Potters Bar, both of England

[73] Assignee: Racal-Amplivox Communications Ltd., Middlesex, England

[21] Appl. No.: 771,781

[22] Filed: Feb. 24, 1977

[30] Foreign Application Priority Data

Apr. 7, 1976 [GB] United Kingdom ..... 14194/76

[51] Int. Cl.[2] ..... A62B 18/00

[52] U.S. Cl. ..... 128/145 R; 128/142.7; 2/171.3

[58] Field of Search ..... 128/145 R, 141 R, 142.7, 128/139, 146.7; 2/171.3, 410, 416, 417, 421, 418, 414, 6

[56] References Cited

U.S. PATENT DOCUMENTS

| | | | |
|---|---|---|---|
| 3,438,060 | 4/1969 | Lobelle et al. | 128/142.7 X |
| 3,963,021 | 6/1976 | Bancroft | 128/145 R |

*Primary Examiner*—Henry J. Recla

*Attorney, Agent, or Firm*—Lawrence E. Laubscher

[57] ABSTRACT

An improved anti-dust helmet comprising a shell spaced from the wearer's head by a supporting harness and provided with a transparent visor sealed at the sides to the wearer's face. Between the helmet shell and the wearer's head there is a sealing member extending continuously from the visor seals around the upper occipital part of the wearer's head. The sealing member is formed of a soft and resilient material and is so formed that the edge of the sealing member that rests against the wearer's head approaches the head at an acute angle. The sealing member may be fabricated or moulded from natural or synthetic rubber or from other elastomeric materials.

5 Claims, 5 Drawing Figures

PROTECTIVE DEVICES

CROSSS REFERENCES TO RELATED APPLICATIONS

Co-pending Patent Application Ser. No. 775,634 for IMPROVED SEALING MEANS FOR PROTECTIVE HEADGEAR filed on Mar. 8, 1977 in the name of Anthony Graham Gorman and claiming the priority of British Patent Application No. 13027/76 dated Mar. 31, 1976 describes an improved form of sealing means for sealing the gap between the visor edges and the wearer's face that is advantageously used in headgear incorporating the present invention.

Co-pending Patent Application Ser. No. 771,769 for IMPROVED VISOR MEANS FOR PROTECTIVE HEADGEAR filed on Feb. 24, 1977 in the names of Brian Arthur Lowe and Raymond Odell and claiming the priority of British Patent Application No. 20050/76 dated May 14th 1976 describes an improved visor assembly for protective headgear which is advantageously used in headgear incorporating the present invention.

BACKGROUND OF THE INVENTION

1. Field of the Invention

This invention relates to an improved form of protective headgear arranged to protect the wearer against a hostile atmosopheric environment.

2. Description of the Prior Art

It is known to provide protective headgear in the form of a helmet including respiratory protective means to enable the wearer to work unharmed in a noxious or dangerous atmospheric environment. Arrangements of this general kind are described for example in U.S. Pat. Nos. 3,963,021 and 3,822,698 .

In a known form of respiratory protective helmet a helmet shell is spaced from a wearer's head to leave an interspace into which air is driven through a filter by a motor-driven fan situated at the rear of the helmet. The filtered air passes over the wearer's head and down in front of his face, being retained by a transparent visor. The rear edge of the visor and the rear portion of the helmet are sealed to the wearer's head by foam material extending between the visor side edges and the wearer's face.

It is also necessary to seal the airflow path existing over the top of the wearer's head. If such sealing is not provided then the air exiting from the filter escapes downwards around the sides and back of the head via the peripheral gap between the head and the rim of the helmet or hood. One known method of achieving this required sealing is to close the gap between the headband which is part of a harness assembly which supports the helmet on the head, and the helmet rim by means of an annular corrugated member of thin flexible and air impermeable material. At this inner edge the annular sealing member is either impermeably attached to the headband or may be made integral with the headband. At its outer edge the annular sealing member is impermeably attached to the helmet rim by some suitable means.

The required airflow from the space between the head and the helmet into the space between the visor and face is achieved by leaving a gap in the forward area of the said annular member which gap is confined within the sealing means at the rear edges of the visor.

This method of achieving the required sealing of the helmet or hood to the head is liable to result in several serious disadvantages. The headband requires to be adjustable in circumference to accommodate the various sizes of heads and this headband size adjustment can only be located at the front of the headband within the confines of the gap in the annular sealing member. This is not a preferred position for the headband size adjustment because the front rim of the helmet and also the visor are then situated too far forward from the face with heads of small circumference, and situated too near to the face with heads of large circumference. The preferred position for the headband size adjustment is at the rear of the headband. Another disadvvantage of the annular sealing arrangement described above is that the annular member cannot change shape sufficiently to permit the required wide range of headband size adjustment. Yet another disadvantage of the described sealing arrangement is that the headband flexibility, in the radial direction, is reduced and the headband is not able to readily conform to the varying shapes of human heads. Discomfort and pressure points are thus produced.

SUMMARY OF THE INVENTION

It is a primary object of the invention to provide a protective headgear having advantages in adaptability and convenience as compared with known headgear.

It is a more specific object of the invention to provide a protective headgear that is more effective in sealing to different head conformations than are known types.

It is a particular object of the invention to provide a protective helmet in which a sealing member by which an air seal between a helmet shell and the wearer's head extends obliquely around the rearward portion of the top of the head between the upper edges of seals by which the visor portion of the helmet is sealed to the wearer's face.

It is a further object of the invention to provide a protective headgear in which an edge of a sealing member which approaches the wearer's head makes contact with the head at an acute angle.

DETAILED DESCRIPTION

Figure 1:
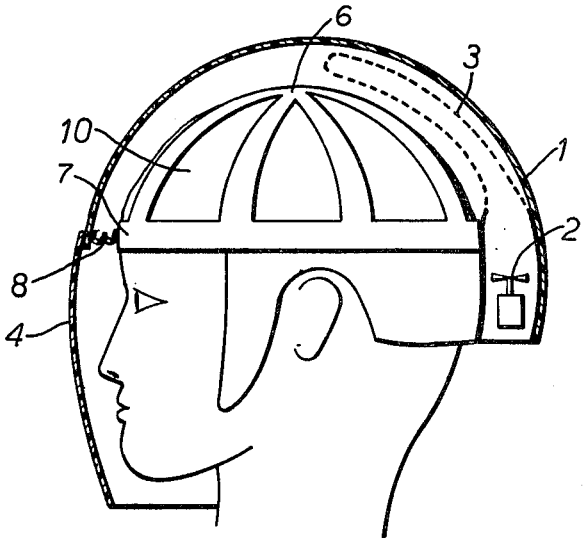
FIG.1. PRIOR ART
FIG. 1 is a sectional side elevation of a prior art protective helmet applied to the head of a wearer.

A known form of protective helmet of the kind to which the invention relates is shown in FIG. 1. A helmet 1 contains an air-moving motor driven fan 2 and a filter element 3 within the space between the helmet and the head. Environmental air is drawn in by the fan 2 and forced through the purifying filter 3. The partially filtered or purified air is then intended to flow over the wearer's head and over his nose and mouth within a transparent visor 4.

The helmet shell 1 is supported spaced apart from the wearer's head 10 by a harness 6 including a headband 7 between which and the helmet shell 1 is disposed an annular sealing member 8.

Figure 2:
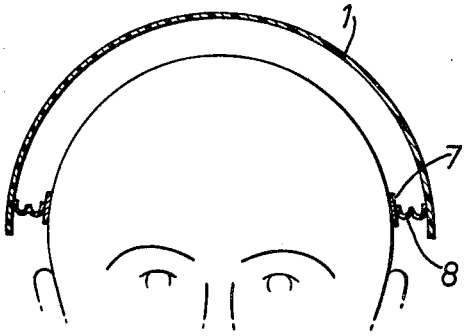
FIG.2. PRIOR ART
FIG. 2 shows a cross section of the known helmet of FIG. 1 applied to the head of a wearer and illustrating a known seal between helmet and head.

FIG. 2 shows a cross-section of the helmet 1 of FIG. 1 with the headband 7 and the aforementioned annular sealing member 8. The required airflow from the space between the head and the helmet into the space between the visor and face is achieved by leaving a gap in the forward area of the said annular member 8 which gap is arranged between the sealing means provided at the rear edges of the visor 4.

In the arrangement to be described hereinafter the required sealing from leakage to atmosphere of the airflow over the top of the head is effected along a line passing from the top edge of one visor/face seal obliquely around the rearward portion of the top of the head to the top edge of the alternate visor/face seal. The sealing member on the one hand seals to the internal profile of the helmet or hood and on the other hand extends inwardly of the helmet so as to seal to the surface of the wearer's head along the mentioned line. The sealing member is made of soft and resilient material and is so proportioned and shaped as to enhance these properties. Further, that edge of the sealing member which rests against the wearer's head advantageously approaches the surface of the head at an acute angle. It is found that as a result an efficient air sealing is obtained whatever the size and shape of the wearer's head. At the rearmost portion of the sealing member an aperture is introduced through which the air from the fan is driven to the air filtering or air purifying member. The improved sealing member can be fabricated or moulded from a suitable grade of natural or synthetic rubber or a variety of synthetic elastomeric materials, of which closedcell polyurethane is particularly suitable.

Figure 3:
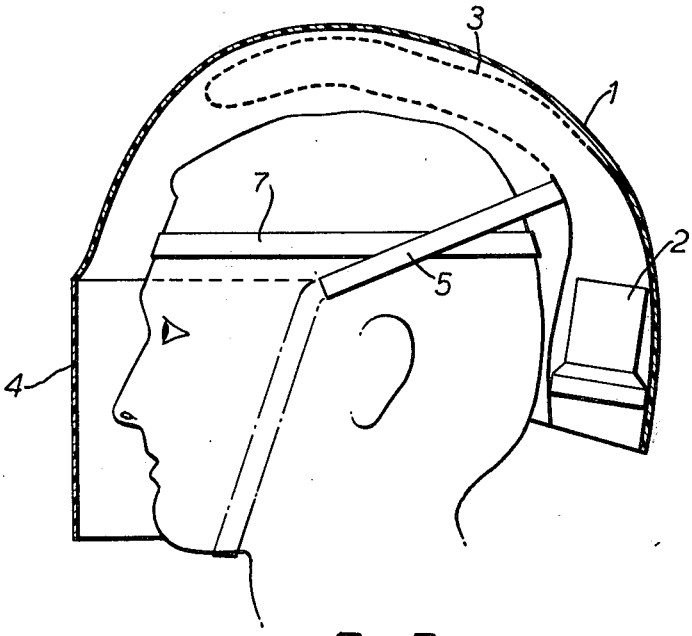
FIG. 3 is a sectional side elevation of a protective helmet in accordance with the invention, applied to the head of a wearer.
Figure 4:
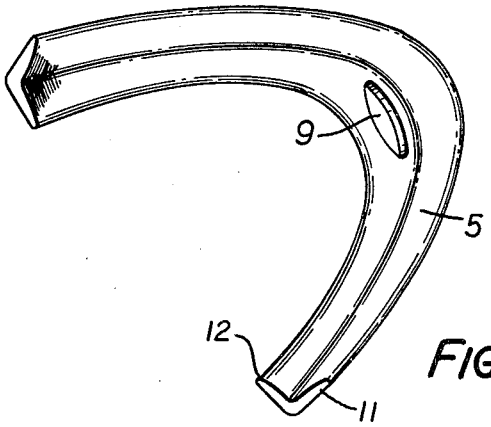
FIG. 4 shows an improved sealing member used in a helmet according to the invention.
Figure 5:
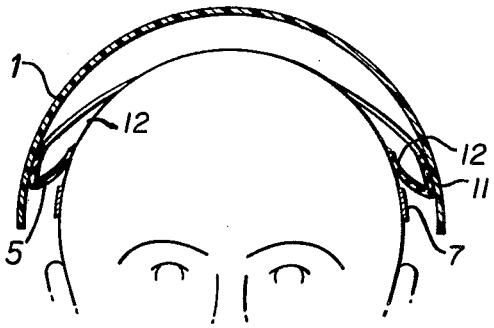
FIG. 5 is a sectional view of the helmet as worn and shows how the sealing member of FIG. 4 fits to the head of a wearer.

FIG. 4 shows a pictorial view of the improved sealing member 5. The outer face 11 is, in practice, shaped as necessary to conform to the relevant portion of the inside surface of the helemt. The inner edge 12 is the apex of a section tapered so as to provide enhanced flexibility and resilience. The reference numeral 9 denotes an aperture through which the air from the air moving fan passes to the filter or air purifier located in the space between the crown of the helmet and the wearer's head. Both the air moving fan and the filter or purifier are sealingly connected to the aperture 9 by any suitable means. The improved sealing member 5 is shown in FIGS. 3 and 5 in position in the helmet assembly and its means of preventing escape of air from the crown area of the helmet interior can be easily appreciated. At the point at which the sealing member 5 crosses the headband 7 the sealing member lies between the headband and the helmet inner surface.

In FIG. 5 is shown the way in which the sealing member 5 seals to the head without causing discomfort and without limiting the size adjustment range of the headband 6. The previously mentioned acute angle at which the edge 12 of the sealing member approaches the surface of the head can be clearly seen.

It will be obvious that the herein described method of sealing a portion of the volume between the interior of the helmet or hood and the surface of the head, can be applied to alternative types of helmet or head assemblies with internal powered airflow, even when the relative disposition of the various components is different from that specifically described herein.

What is claimed is:

1. An improved anti-dust helmet including a hollow helmet shell member having inner and outer surfaces, said helmet shell member containing a lower open portion for receiving a user's head, and an open front viewing portion; air circulation means arranged within the rear portion of said helmet shell member for directing air forwardly of the helmet; supporting harness means connected within the helmet shell member for spacing the inner surface thereof from the user's head; transparent visor means mounted across the helmet open front viewing portion, said visor means being connected at its upper edge portion with said helmet shell member and being adapted at its side edges for sealing engagement with the user's face;

the improvement which comprises sealing means for sealing the space between the occipital portion of the user's head and the inner surface of said helmet shell member, said sealing means including a soft resilient generally U-shaped member having an outer peripheral surface in sealed engagement with the inner surface of the helmet shell member, a deformably generally planar web portion extending radially inwardly from said outer peripheral surface, and an inner peripheral surface adapted for sealing engagement with the occipital portion of the user's head, said sealing member containing an air circulation opening in fluidic communication with said air circulation means, whereby air from said circulation means passes through said opening forwardly of the helmet.

2. An anti-dust helmet is defined in claim 1, wherein said sealing member extends from one upper corner of side visor member obliquely along a line around the helmet crown to the opposite upper corner of said visor member.

3. An anti-dust helmet as defined in claim 1, wherein said sealing member has a transverse cross-section of a generally L-shaped configuration, said sealing member outer peripheral surface comprising an upstanding side wall portion connected in sealing relationship with the inner surface of said helmet shell member.

4. An anti-dust helmet as defined in claim 1, wherein said sealing member is formed from a synthetic material.

5. An anti-dust helmet as defined in claim 4, wherein said sealing member is formed of a closed-cell foamed polyurethane.

* * * * *